US006817838B2

(12) United States Patent
Mori

(10) Patent No.: US 6,817,838 B2
(45) Date of Patent: Nov. 16, 2004

(54) FUEL INJECTION PUMP WITH A FILTER

(75) Inventor: Katsumi Mori, Chiryu (JP)

(73) Assignee: Denso Corporation (JP)

( * ) Notice: Subject to any disclaimer, the term of this patent is extended or adjusted under 35 U.S.C. 154(b) by 11 days.

(21) Appl. No.: 10/285,585

(22) Filed: Nov. 1, 2002

(65) Prior Publication Data

US 2003/0095875 A1 May 22, 2003

(30) Foreign Application Priority Data

Nov. 21, 2001 (JP) ..... 2001-355821

(51) Int. Cl.[7] ..... F04B 25/00; F02M 37/04
(52) U.S. Cl. ..... 417/244; 417/313; 123/495
(58) Field of Search ..... 417/244, 313; 123/90.12, 503, 508, 509, 449, 515, 495

(56) References Cited

U.S. PATENT DOCUMENTS

| | | | | |
|---|---|---|---|---|
| 3,299,824 A | | 1/1967 | Gauthier | 103/120 |
| 3,614,267 A | | 10/1971 | Schultze et al. | 417/206 |
| 3,657,971 A | | 4/1972 | Freeman | 91/487 |
| 4,508,489 A | * | 4/1985 | Howes | 417/221 |
| 4,531,488 A | * | 7/1985 | Kawamura et al. | 123/300 |
| 4,686,829 A | | 8/1987 | Thoma et al. | 60/464 |
| 5,000,668 A | * | 3/1991 | Nakamura et al. | 417/492 |
| 5,549,452 A | | 8/1996 | Vogt | 417/199.1 |
| 5,688,110 A | * | 11/1997 | Djordjevic | 417/254 |

FOREIGN PATENT DOCUMENTS

| | | | |
|---|---|---|---|
| DE | 4103986 A1 | 8/1991 | F04B/23/12 |
| DE | 19913774 A1 | 10/2000 | F02M/59/06 |
| JP | 5-87264 | 11/1993 | F02M/41/12 |

* cited by examiner

*Primary Examiner*—Charles G. Freay
(74) *Attorney, Agent, or Firm*—Nixon & Vanderhye PC

(57) ABSTRACT

In a fuel injection pump, a casing fixed to a housing has a pump room and a filter room mostly separated from but partly communicating with the pump room. A feed pump is constituted by the pump room where a feed pump mechanism is connected to an axial end of the drive shaft. A filter element is accommodated in the filter room. A casing cover easily attachable and detachable to the casing has a fuel inlet port through which fuel is sucked to the filter room and, then, flows via the filter element into the pump room where the fuel is pressurized according to rotation of the drive shaft. Accordingly, foreign material contained in fuel is eliminated before entering the pump room. Further, fuel flow area of the fuel element is larger than that of the fuel inlet port, resulting in less pressure loss of fuel passing through the filter element even if mesh size of filter element is smaller.

5 Claims, 2 Drawing Sheets

FUEL INJECTION PUMP WITH A FILTER

CROSS REFERENCE TO RELATED APPLICATION

This application is based upon and claims the benefit of priority of Japanese Patent Application No. 2001-355821 filed on Nov. 21, 2001, the content of which is incorporated herein by reference.

BACKGROUND OF THE INVENTION

1. Field of the Invention

The present invention relates to a fuel injection pump for an internal combustion engine (hereinafter called "engine").

2. Description of the Prior Art

Conventionally, a common rail fuel injection system is known typically as a system for supplying fuel to a diesel engine. The common rail fuel injection system is provided with a fuel injection pump in which plungers as moving members make reciprocating movement according to rotation of a drive shaft so that fuel supplied to pressure chambers are pressurized by the plungers. When pressure of the pressurized fuel reaches a given value, the pressurized fuel is discharged from each of the pressure chambers to a common rail.

In a case of the fuel injection pump mentioned above, a housing, in which the pressure chambers are formed in cooperation with the plungers, is equipped with a feed pump for supplying fuel to the pressure chambers. The feed pump is arranged at an end of the drive shaft, which reciprocatingly drives the plungers, and is driven according to rotation of the drive shaft so that fuel stored in a fuel tank is delivered to the pressure chambers.

In the conventional fuel injection pump, a fuel filter provided in the fuel tank eliminates foreign material contained in the fuel. Further, a filter element arranged in the housing of the fuel injection pump on a side of the fuel inlet port serves to eliminate foreign material produced in a fuel delivery pipe extending from the fuel tank to the feed pump and foreign material produced from the fuel filter itself before these foreign material flow into the feed pump.

However, the housing of the fuel injection pump does not have enough space to mount the filter element in view of conventional shape of the fuel injection pump. Accordingly, the filter element is relatively compact so that mesh size of the filter element has to be relatively large to reduce pressure loss of fuel passing though the filter element. The filter element whose mesh size is large can not eliminate minute foreign material, so efficiency of filtrating the foreign material is not high. If the foreign material having passed through the filter element enters various sliding portions formed in the fuel injection pump, the foreign material is apt to hinder smooth operation of the sliding portions, thereby the fuel injection pump has a risk of jeopardizing highly accurate fuel amount control.

Further, the conventional filter element is installed typically in a passage formed in the housing of the fuel injection pump. Accordingly, it is difficult and troublesome to replace the filter element positioned in the passage.

SUMMARY OF THE INVENTION

An object of the present invention is to provide a fuel injection pump in which minute foreign material is eliminated without causing significant pressure loss, which enables highly accurate fuel flow control and in which a fuel member is easily replaced.

To achieve the above object, in the fuel injection pump, a casing fixed to an outer surface of a housing is provided at a position adjacent to the housing with a pump room and at a position remote from the housing with a filter room mostly separated from but partly communicating with the pump room. An axial end of a drive shaft protrudes into the pump room. A feed pump is constituted by the pump room where a feed pump mechanism is connected with the axial end of the drive shaft. A filter element is accommodated in the filter room. A casing cover attached to the casing has a fuel inlet port through which fuel is sucked to the filter room and, then, flows via the filter element into the pump room where fuel is pressurized according to rotation of the drive shaft. Accordingly, foreign material contained in fuel is eliminated before entering the pump room.

The filter element is accommodated in the filter room of the casing at the position remote from the housing so that the filter element is easily replaced, for example, for a maintenance purpose by detaching the casing cover from the casing. It is preferable, therefore, that the casing cover is attached to the casing, for example, by bolts, so that the casing cover may be easily detached therefrom.

Since the filter room is formed in the casing at the position remote from the housing and there is no size limitation of inner space of the filter room, the inner space of the filter room can be sufficiently large to accommodate larger size of the filter element.

It is preferable that fuel flow area of the fuel element is larger than that of the fuel inlet port.

Further, preferably, the pump and filter rooms are formed substantially in column shape and inner diameter of the filter room is substantially equal to that of the pump room.

Employment of the larger size of the filter element results in less pressure loss of fuel passing through the filter element even if mesh size of the filter element is smaller. Since foreign material, even if it is minute, is eliminated by the filter element, there is few foreign material entering sliding portions of the fuel injection pump, which enables highly accurate fuel flow control of the fuel injection pump.

Moreover, it is preferable that the casing is composed of a cylindrical casing body and a partition dividing axially inner space of the casing body into two spaces that constitute the pump and filter rooms, respectively. Preferably, the partition has a communication hole through which the filter room communicates with the pump room. The casing mentioned above has a simpler construction in which the casing can be easily fixed to the housing and the feed pump mechanism and the filter element can be easily assembled thereto.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

A preferred embodiment of the present invention is described with reference to drawings.

Figure 1:
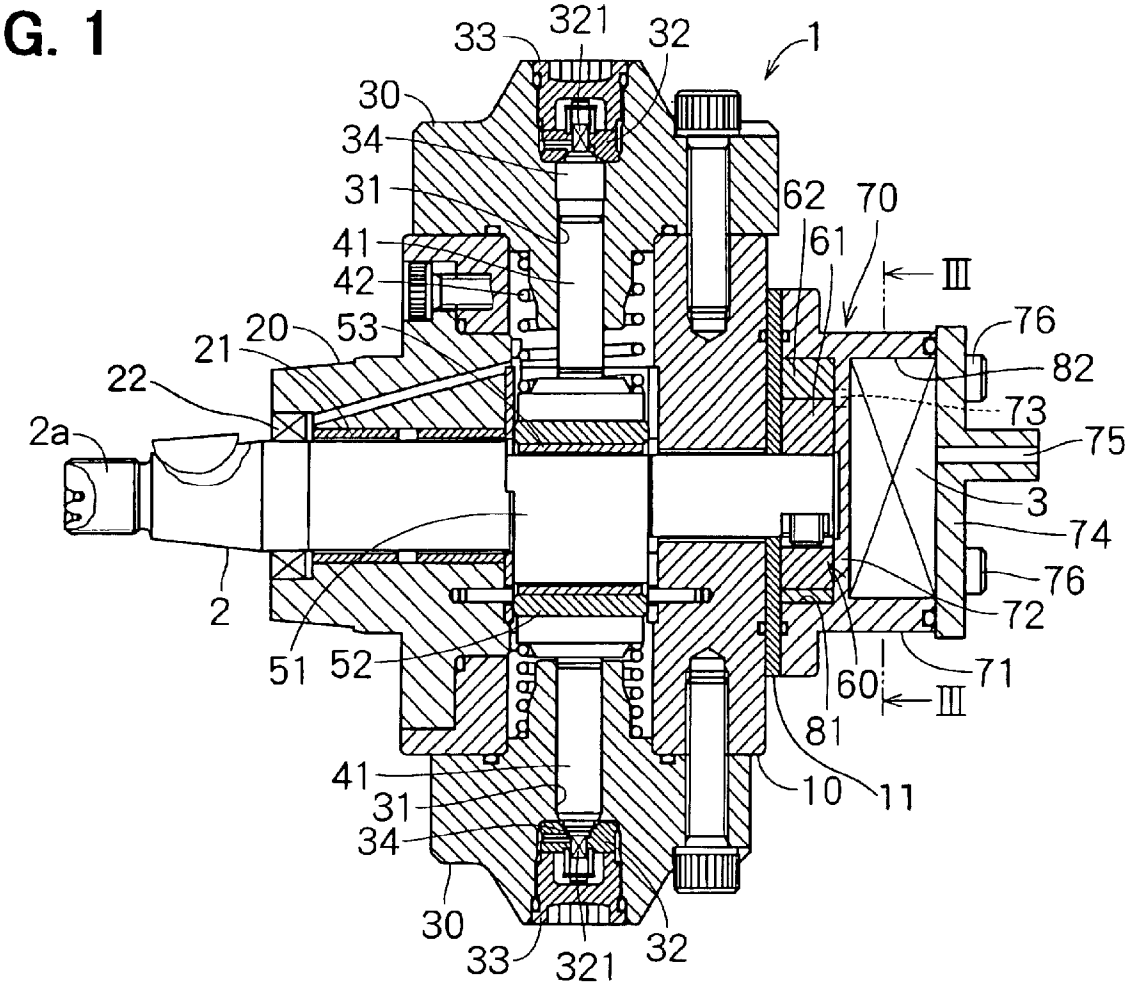
FIG. 1 is a schematic cross sectional view of a fuel injection pump according to a preferred embodiment of the present invention.

FIG. 1 shows a fuel injection pump 1 according to the preferred embodiment. The fuel injection pump 1 is applied to a common rail fuel injection system.

As shown in FIG. 1, the fuel injection pump I has a housing body 10, a housing cover 20 and cylinder heads 30. The housing body 10 and the housing cover 20 are made of aluminum. Each of the cylinder heads 30 is formed of iron and is provided inside with a cylinder 31. A plunger 41 as a moving member is slidably and reciprocatingly accommodated in the cylinder 31. Each of the cylinder heads 30 is provided with a check valve 32 plugging an end of the cylinder 31. The check valve 32 is fixed to the cylinder head 30 by fitting a seal member 33 thereto. A pressure chamber 34 is formed by an inner circumferential surface of the cylinder head 30, an end of the check valve 32 and an axial end of the plunger 41.

Figure 2:
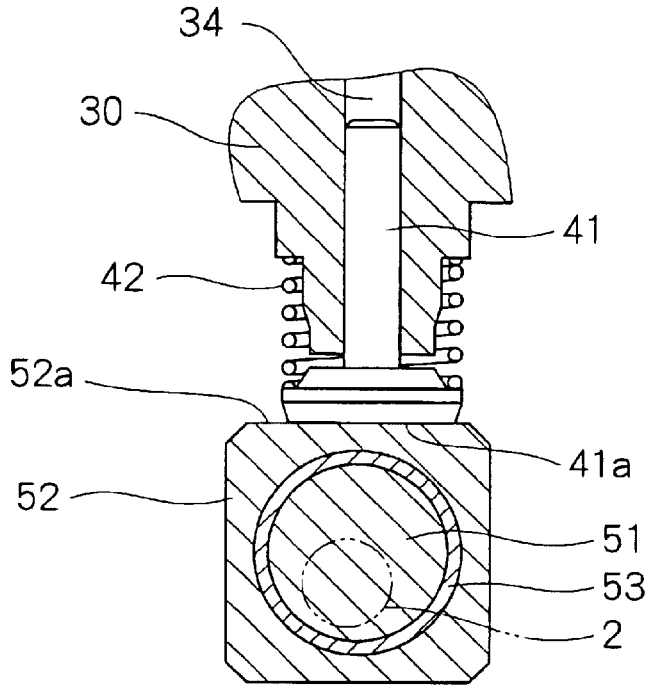
FIG. 2 is a schematic cross sectional view showing about sliding portions of a plunger and a cam ring of the fuel injection pump taken along a line perpendicular to an axis of a drive shaft in FIG. 1.

A drive shaft 2 is rotatably held via a journal 21 by the housing cover 20 and the housing body 10. An oil seal 22 seals a space between the housing cover 20 and the drive shaft 2. As shown in FIG. 2, a cam 51 whose cross sectional shape is circular is formed eccentrically and integrally with the drive shaft 2. FIG. 2 shows a part view of the fuel injection pump 1 rotated by 90° from that shown in FIG. 1, that is, a cross sectional view taken along a line perpendicular to an axis of the drive shaft 2 for illustrating about sliding portions of the plunger 41 and the cam 51. Four pieces of the plungers 41 are arranged circumferentially at regular angular intervals with respect to the axis of the drive shaft 2 (two plungers 41 are shown in FIG. 1). As shown in FIG. 2, a cam ring 52 has a square shaped profile. A bush 53 is interposed between the cam ring 52 and the cam 51 so that the bush 53 can slide on both of the cam ring 52 and the cam 51. An outer circumference surface 52*a* of the cam ring 52 facing the plunger 41 and an end face 41*a* of the plunger 41 are flat and in contact with each other so as to constitute sliding portions. An inside of the housing composed of the housing body 10, the housing cover 20 and the cylinder heads 30 are filed with light oil. The sliding portions of the cam ring 52 and the plungers 41 are lubricated by fuel.

Each of the plungers 41 is reciprocatingly driven via the cam ring 52 by the cam 51 according to rotation of the drive shaft 2 and pressurizes fuel sucked into the pressure chamber 34 through the check valve 32 from a fuel flow-in passage (not shown). The check valve 32 has a valve member 321 and is operative to prevent fuel from flowing in reverse from the pressure chamber 34 to the fuel flow-in passage. The fuel flow-in passage is formed inside the housing body 10 and each of the cylinder heads 30. An end of the fuel flow-in passage communicates with the pressure chamber 34 via the check valve 32 and the other end thereof communicates with a feed pump 60. A fuel amount adjusting valve (not shown) is disposed on a way of the fuel flow-in passage through which each of the pressure chambers 34 communicates with the feed pump 60. The fuel amount adjusting valve is operative to adjust an amount of fuel to be supplied to each of the pressure chambers 34 so that an amount of fuel to be discharged from the pressure chamber 34 to the common rail (not shown) is a given value. The fuel amount adjusting valve is a spool valve in which a valve body is driven to move according to values of current applied to a coil and a fuel flow area is variable according to moving amounts of the valve body.

A spring 42 urges the plunger 41 toward the cam ring 52. The cam ring 52 slidably revolves around the cam 51 without self-rotating according to the rotation of the cam 51. Accordingly, sliding portions of the cam ring 52 and the plunger 41 moves reciprocatingly in right and left directions in FIG. 2 and the plunger 41 moves reciprocatingly upward and downward in the cylinder 31.

Each of the cylinder heads 30 is provided with a fuel flow-out passage (not shown). The fuel flow-out passage is formed to extend forward or backward from the pressure chamber 34 in FIG. 1. An end of the fuel flow-out passage communicates with the pressure chamber 34 and the other end thereof communicates with the common rail. The fuel flow-out passage is provided with a check valve (not shown), which is opened, when pressure of fuel in the pressure chamber 34 reaches a given pressure, to allow fuel flow from the pressure chamber 34 to the common rail but prohibit fuel flow from the common rail to the pressure chamber 34.

The feed pump 60 is arranged at an axial end of the drive shaft 2. The feed pump 60 has an inner rotor 61 and an outer rotor 62 (feed pump mechanism). The inner rotor 61 is connected to the axial end of the drive shaft 2 that protrudes out of the housing body 10. The inner and outer rotors 61 and 62 are relatively rotatable and, when the inner rotor 61 rotates together with the drive shaft 2, fuel is fed from the fuel tank to each of the pressure chambers 34. A power transmitting portion 2*a* is formed at the other axial end of the drive shaft 2 so that the drive shaft 2 is driven to rotate by driving force transmitted from an engine to the power transmitting portion 2*a*.

The feed pump 60 is provided in a casing 70 easily attachable or detachable to the housing body 10. The casing 70 has a pump room 81 in which the inner and outer rotors 61 and 62 of the feed pump 60 are accommodated. A bush 11 is interposed between the casing 70 and the housing body 10 for preventing fuel leakage from the pump room 81 to outside through a gap between the casing 70 and the housing body 10.

The casing 70 is formed approximately in cylindrical shape. The casing 70 is composed of a cylindrical body 71 and a partition 72 dividing inner space of the cylindrical body 71 into two spaces. That is, a cross section of the casing 70 taken along an axis thereof is formed substantially in a letter H shape. The inner space of the cylindrical body 71 on a side of the drive shaft 2, that is, on a side of the housing body 10 is the pump room 81 in which the inner and outer rotors 61 and 62 are accommodated. The inner space of the cylindrical body 71 on a side opposite to the drive shaft 2, that is, on a side opposite to the housing body 10 is a filter room 82 in which a filter element 3 is accommodated. The partition 72 is provided with a communication hole 73 through which the filter room 82 communicates with the pump room 81 for supplying fuel to an intake port of the pump room 81. Inner diameter of the pump room 81 is substantially same to that of the filter room 82, since inner diameter of the casing body 71 is axially nearly uniform.

The casing 70 is provided at an axial end thereof on a side opposite to the drive shaft 2 with a cover 74 for covering the filter room 82. The cover 74 is easily attachable and detachable to the casing 70. The cover 74 is formed in shape of a disk whose outer diameter corresponds to that of the casing 70. A fuel inlet port 75, which communicates with the filter room 82, is formed in the cover 74. An end of the fuel inlet port 75 on a side opposite to the filter room 82 communicates with the fuel tank so that fuel stored in the fuel tank is flowed into the filter room 82 through the fuel inlet port 75. The fuel inlet port 75 may be arranged at any position of the cover 74 where the fuel inlet port 75 can communicate with the filter room 82.

The fuel inlet port 75 is connected to a fuel supply passage (not shown) through which the fuel tank is connected to the fuel injection pump 1. Inner diameter of the fuel inlet port 75 is substantially same as that of the fuel supply passage. On the other hand, the inner diameter of the filter room 82, which is substantially same as that of the pump room 81, is larger than that of the fuel inlet port, consequently, fuel flow area of the filter room is larger than that of the fuel inlet port.

Figure 3:
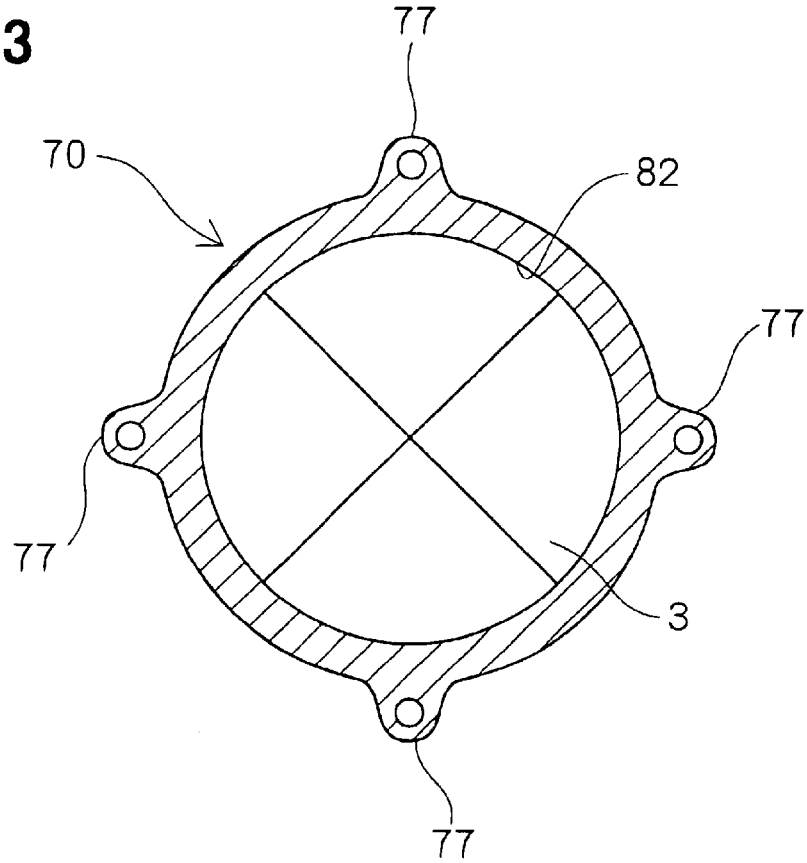
FIG. 3 is a cross sectional view taken along a line III—III of FIG. 1.

The cover 74 is fixed to the casing 70 by fixing members 76 such as bolts. As shown in FIG. 3, the casing 70 has installation portions 70, to which the fixing members 76 are attached. Accordingly, the cover 74 can be easily detached for replacing the filter element 3 accommodated in the filter room 82.

The inner and outer rotors 61 and 62 are accommodated in the pump room 81 with a given clearance between an outer circumference of the outer rotor 62 and an inner circumference of the pump room 81. The filter element 3 is accommodated in the filter room 82 without a substantial clearance (if any, with a minute clearance) between an outer circumference of the filter element 3 and an inner circumference of the filter room 82. The filter element 3 is formed in column shape corresponding to that of the filter room 82. The filter element 3 eliminates foreign material produced in the supply passage between the fuel tank and the fuel injection pump 1 or in a fuel filter (not shown) disposed in the fuel tank. The fuel filter 3 is typically made of filter paper, fiber cluster or metal nets.

An operation of the fuel injection pump 1 is briefly described below.

The feed pump 60 is driven by rotation of the inner rotor 61 according to rotation of the drive shaft 2 which causes a relative rotating movement between the inner and outer rotors 61 and 62. Upon driving the feed pump 60, fuel stored in the fuel tank is flowed via the fuel supply passage and the fuel inlet port 75 into the filter room 82 where the filter element 3 is accommodated and, after passing through the filter element 3 and having eliminated foreign material in the filter room 82, via the communication hole 73 into the pump room 81. In the pump room 81, the fuel is pressurized by the relative rotating movement between the inner and outer rotors 61 and 62. Then, the pressurized fuel by the feed pump 60 is supplied to the pressure chamber 34 via the fuel flow-in passage formed in the housing body 10 and the cylinder head 30. The amount of fuel supplied to the pressure chamber 34 is adjusted by the fuel amount adjusting valve disposed between the feed pump 60 and the pressure chamber 34.

The fuel having passed through the fuel amount adjusting valve is sucked when the plunger 41 moves downward in the cylinder 31 according to the rotation of the drive shaft 2. The fuel in the pressure chamber 34 is pressurized by an upward movement of the plunger 41 in the cylinder 31. When pressure of the fuel in the pressure chamber 34 reaches a given value, the check valve provided in the fuel flow-out passage communicating with the pressure chamber 34 is opened so that the fuel in the pressure chamber 34 is discharged to the common rail. In the common rail, the fuel, which is supplied from the fuel injection pump 1 and whose pressure is variable, is accumulated so as to keep predetermined uniform pressure. The fuel accumulated in the common rail is delivered to each of injectors for spraying to each cylinder of the engine.

In the fuel injection pump 1 according to the preferred embodiment, the casing 70, in which the pump room 81 of the feed pump 60 and the filter room 82 are formed, is fixed to the housing body 10 at the axial end of the drive shaft 2. The inner diameter of the filter room 82 is substantially equal to that of the pump room 81 so that a flow area of fuel passing through the filter element 3 is larger than that of the fuel supply passage between the fuel tank and the fuel injection pump 1. Accordingly, due to less pressure loss of fuel passing through the filter element 3, smaller mesh size of the filter element 3 is employed so that foreign material contained in fuel, even if it is minute, may be eliminated before entering the pump room 81, that is, before entering the fuel injection pump 1. As a result, foreign material hardly invades a plurality of sliding portions of the fuel injection pump 1 such as the sliding portions of the fuel amount adjusting valve and the sliding portions of the cam ring 52 and the plungers 41, which results in securing smooth operation on the sliding portions, enabling highly accurate fuel amount control and enhancing reliability of the fuel injection pump 1.

According to the embodiment mentioned above, since the cover 74 is easily detached from the casing 70, it is easy to replace the filter element 3 accommodated in the filter room 82.

Further, the filter room 82 and the pump room 81 are formed by dividing the inner space of the casing 70 into two spaces only with a partition 72 integrally provided therein so that simpler construction of the casing 70, which is easily handled, can be achieved without increasing parts number thereof.

What is claimed is:

1. A fuel injection pump comprising:

a housing having a cylinder;

a moving member slidably and reciprocatingly movable in the cylinder, an inner circumference of the cylinder and an axial end of the moving member forming a pressure chamber;

a drive shaft which is rotatably disposed in the housing and whose axial end partly protrudes out of the housing, the drive shaft having a cam member slidably in contact with the moving member;

a casing fixed to an outer surface of the housing, the casing being provided at a position adjacent to the housing with a first room into which the axial end of the drive shaft protrudes and at a position remote from the housing with a second room mostly separated from but partly communicating with the first room;

a feed pump mechanism accommodated in the first room and connected to the axial end of the drive shaft so that a feed pump is constituted by the first room, the feed pump mechanism and the drive shaft;

a filter element accommodated in the second room;

a casing cover detachably fixed to so as to be readily detachable from the casing on a side axially opposite to the first room with respect to the filter element for covering the second room so that, when the casing cover is detached from the casing, the filter element may be readily replaced by being drawn out in an axial direction of the drive shaft, the casing cover having a fuel inlet port that extends in parallel to an axial direction of the drive shaft and through which fuel is sucked to the second room and, then, flows via the filter element into the first room where the fuel is pressurized according to rotation of the drive shaft; and a fuel flow-in passage provided in the housing for delivering fuel from the feed pump to the pressure chamber, wherein fuel introduced to the pressure chamber from the feed pump is further pressurized and discharged to outside by the moving member that is driven by the cam member according to rotation of the drive shaft.

2. A fuel injection pump according to claim 1, wherein a cross sectional area of the filter element perpendicular to an axis thereof is larger than that of the fuel inlet port.

3. A fuel injection pump comprising:

a housing having a cylinder;

a moving member slidably and reciprocatingly movable in the cylinder, inner circumference of the cylinder and an axial end of the moving member forming a pressure chamber;

a drive shaft which is rotatably disposed in the housing and whose axial end partly protrudes out of the housing, the drive shaft having a cam member slidably in contact with the moving member;

a casing fixed to an outer surface of the housing, the casing being provided at a position adjacent to the housing with a first room into which the axial end of the drive shaft protrudes and at a position remote from the housing with a second room mostly separated from but partly communicating with the first room;

a feed pump mechanism accommodated in the first room and connected to the axial end of the drive shaft so that a feed pump is constituted by the first room, the feed pump mechanism and the drive shaft;

a filter element accommodated in the second room;

a casing cover attached to the casing for covering the second room, the casing cover having a fuel inlet port through which fuel is sucked to the second room and, then, flows via the filter element into the first room where the fuel is pressurized according to rotation of the drive shaft; and a fuel flow-in passage provided in the housing for delivering fuel from the feed pump to the pressure chamber, wherein fuel introduced to the pressure chamber from the feed pump is further pressurized and discharged to outside by the moving member that is driven by the cam member according to rotation of the drive shaft, and wherein the first and second rooms are formed substantially in column shape and inner diameter of the first room is substantially equal to that of the second room.

4. A fuel injection pump comprising:

a housing having a cylinder;

a moving member slidably and reciprocatingly movable in the cylinder, inner circumference of the cylinder and an axial end of the moving member forming a pressure chamber;

a drive shaft which is rotatably disposed in the housing and whose axial end partly protrudes out of the housing, the drive shaft having a cam member slidably in contact with the moving member;

a casing fixed to an outer surface of the housing, the casing being provided at a position adjacent to the housing with a first room into which the axial end of the drive shaft protrudes and at a position remote from the housing with a second room mostly separated from but partly communicating with the first room;

a feed pump mechanism accommodated in the first room and connected to the axial end of the drive shaft so that a feed pump is constituted by the first room, the feed pump mechanism and the drive shaft;

a filter element accommodated in the second room;

a casing cover attached to the casing for covering the second room, the casing cover having a fuel inlet port through which fuel is sucked to the second room and, then, flows via the filter element into the first room where the fuel is pressurized according to rotation of the drive shaft; and a fuel flow-in passage provided in the housing for delivering fuel from the feed pump to the pressure chamber, wherein fuel introduced to the pressure chamber from the feed pump is further pressurized and discharged to outside by the moving member that is driven by the cam member according to rotation of the drive shaft, and wherein the casing comprises a cylindrical casing body and a partition dividing axially inner space of the casing body into two spaces that constitute the first and second rooms, respectively.

5. A fuel injection pump according to claim 4, wherein the partition has a communication hole through which the first room communicates with the second room.

* * * * *